US010774623B2

(12) United States Patent
Daly et al.

(10) Patent No.: US 10,774,623 B2
(45) Date of Patent: Sep. 15, 2020

(54) PERFORATING GUN FOR OIL AND GAS WELLS, PERFORATING GUN SYSTEM, AND METHOD FOR PRODUCING A PERFORATING GUN

(71) Applicant: Expro North Sea Limited, Dyce, Aberdeenshire (GB)

(72) Inventors: Kerry G. Daly, Conroe, TX (US); Ronald S. Fordyce, Aberdeen (GB)

(73) Assignee: Expro North Sea Limited, Dyce (GB)

( * ) Notice: Subject to any disclaimer, the term of this patent is extended or adjusted under 35 U.S.C. 154(b) by 254 days.

(21) Appl. No.: 15/411,230

(22) Filed: Jan. 20, 2017

(65) Prior Publication Data

US 2018/0209250 A1 Jul. 26, 2018

(51) Int. Cl.

| | |
|---|---|
| ***E21B 43/117*** | (2006.01) |
| ***E21B 29/02*** | (2006.01) |
| ***E21B 43/116*** | (2006.01) |
| ***E21B 43/1185*** | (2006.01) |
| ***F42B 1/028*** | (2006.01) |

(52) U.S. Cl.
CPC ..... *E21B 43/117* (2013.01); *E21B 43/1185* (2013.01); *F42B 1/028* (2013.01)

(58) Field of Classification Search
CPC ..... E21B 43/117; E21B 29/02; E21B 43/116
See application file for complete search history.

(56) References Cited

U.S. PATENT DOCUMENTS

| | | | |
|---|---|---|---|
| 4,191,265 | A | 3/1980 | Bosse-Platiere |
| 4,850,438 | A | 7/1989 | Regalbuto |
| 9,238,956 | B2 | 1/2016 | Martinez |
| 9,382,784 | B1 | 7/2016 | Hardesty et al. |
| 9,441,438 | B2 | 9/2016 | Allison et al. |
| 9,441,466 | B2 | 9/2016 | Coffey et al. |
| 9,494,021 | B2 | 11/2016 | Parks et al. |
| 2015/0240607 | A1 | 8/2015 | Hales et al. |

OTHER PUBLICATIONS

International search report for PCT/GB18/50146 dated Apr. 20, 2018.

*Primary Examiner* — Catherine Loikith
(74) *Attorney, Agent, or Firm* — Getz Balich LLC

(57) ABSTRACT

A perforating gun, perforating gun system, and method for producing the same is provided. The perforating gun includes a body and at least one cavity liner. The body has an axial length extending between a first axial end and a second axial end, and an outer radial surface extending between the first and second axial ends, an inner bore, and at least one shaped charge cavity disposed in the outer radial surface. The at least one shaped charge cavity is in fluid communication with the inner bore. The at least one cavity liner is disposed in the shaped charge cavity and is configured to retain an explosive material within the shaped charge cavity.

18 Claims, 5 Drawing Sheets

PERFORATING GUN FOR OIL AND GAS WELLS, PERFORATING GUN SYSTEM, AND METHOD FOR PRODUCING A PERFORATING GUN

BACKGROUND OF THE INVENTION

1. Technical Field

The present disclosure relates to equipment for use in a subterranean well for hydrocarbon fluid production, and in particular to a shaped charge perforating gun apparatus for generating perforations within a well casing.

2. Background Information

Subterranean wellbores are often created to provide access to a hydrocarbon bearing subterranean formation so that hydrocarbon materials may be removed from the formation. Typically, a wellbore is drilled and a hollow well casing is inserted into the well bore. The well casing increases the integrity of the wellbore and the interior passage of the well casing provides a path through which fluids from the formation may be produced to the surface. In some instances, voids between the well bore and the exterior of the well casing may be filled with a material (e.g., cement) to secure the well casing within the well bore. To permit the influx of fluids into the well casing (and removal from the well) it is necessary to create hydraulic openings or perforations through the well casing (and cement where used) to provide fluid communication between the interior passage of the well casing and the exterior geologic formation.

According to the prior art, the aforesaid perforations may be created by detonating a series of shaped charges located within one or more hollow body perforating guns that are deployed within the well casing at selected positions within the well bore. The shaped charges are disposed within charge holders positioned within the interior of the hollow body. The shaped charges include an explosive material and are in communication with a detonating cord. The detonating cord provides the energy necessary to detonate the shaped charges. Upon detonation the shaped charges produce explosive jets that cause penetration of the hollow body containing the shaped charges, the well casing wall (the exterior cement if used), and the adjacent formation to some degree. Prior art examples of perforating guns are disclosed in U.S. Pat. Nos. 9,238,956; 9,382,784; 9,441,438; 9,441,466; and 9,494,021.

In some applications, the hydrostatic pressure within the well bore/well casing during the well formation process can be enormous; e.g., in the range of about 20,000 to about 25,000 psi. Equipment used within the well bore to form the well (e.g., perforating guns) must, therefore, be designed to function in the aforesaid high pressure environment. A perforating gun for use in a seven inch (7") diameter pipe, for example, may have a tubular hollow body with a four and three-quarters inch (4.75") outer diameter. To accommodate the shaped charges disposed with charged holders, the interior of the hollow body must have a large inner diameter (e.g., 3.626 inches) and consequent relatively thin wall thickness. To accommodate the high hydrostatic pressures, the hollow body of such a perforating gun is typically made of a very high yield strength material (e.g., a yield strength of about 150,000 psi). Such materials are almost always quite expensive and typically available only on special order with a long lead time for delivery.

There are other disadvantages associated beyond the expense and lead time typically associated with the hollow body of perforating guns such as those described above and in the identified patents. For example, these type devices also utilize structures (e.g., "metal liners") designed to hold the shaped charges. The explosive material must be packed into the metal liners at very high pressures to achieve the desired explosive performance, which is an expensive process. Furthermore, the aforesaid designs typically use a detonation cord to energize the shaped charges. Detonation cords typically include an explosive material packed within a fabric tube that can include voids when exposed to well conditions; i.e., voids that may cause the detonating cord and therefore the penetrating gun to fail.

SUMMARY OF THE INVENTION

The following presents a simplified summary in order to provide a basic understanding of some aspects of the disclosure. The summary is not an extensive overview of the disclosure. It is neither intended to identify key or critical elements of the disclosure nor to delineate the scope of the disclosure. The following summary merely presents some concepts of the disclosure in a simplified form as a prelude to the description below.

According to an aspect of the present disclosure, a perforating gun is provided. The perforating gun includes a body and at least one cavity liner. The body has an axial length extending between a first axial end and a second axial end, and an outer radial surface extending between the first and second axial ends, an inner bore, and at least one shaped charge cavity disposed in the outer radial surface. The at least one shaped charge cavity is in fluid communication with the inner bore. The at least one cavity liner is disposed in the shaped charge cavity and is configured to retain an explosive material within the shaped charge cavity.

According to another aspect of the present disclosure a perforating gun system is provided that includes a plurality of perforating gun sections, with each section connected to at least one other perforating gun section. Each perforating gun section includes a body and at least one cavity liner. The body has an axial length extending between a first axial end and a second axial end, and an outer radial surface extending between the first and second axial ends, an inner bore, and at least one shaped charge cavity disposed in the outer radial surface. The at least one shaped charge cavity is in fluid communication with the inner bore. The at least one cavity liner is disposed in the shaped charge cavity and is configured to retain an explosive material within the shaped charge cavity.

In any of the above aspects, the perforating gun body may include at least one inner bore fluid escape port in communication with the inner bore, which inner bore fluid escape port extends from the inner bore to an exterior of the body.

In any of the above aspects and embodiments, the inner bore may extend between and be in fluid communication with the first axial end and the second axial end.

In any of the above aspects and embodiments, the perforating gun body may further include at least one cavity fluid escape port in communication with each shaped charge cavity, which cavity fluid escape port extends from the respective shaped charge cavity to an exterior of the body.

In any of the above aspects and embodiments, the perforating gun may further include an explosive material disposed within the inner bore and within the at least one shaped charge cavity.

In any of the above aspects and embodiments, the inner bore has a diameter and the body has an outer diameter, and a ratio of the outer diameter of the body to diameter of the inner bore may be in the range of about 7:1 to about 19:1.

According to another aspect of the present disclosure, a method of producing a perforating gun is provided. The method includes: a) providing a perforating gun body having an axial length extending between a first axial end and a second axial end, and an outer radial surface extending between the first and second axial ends, an inner bore, and a plurality of shaped charge cavities disposed in the outer radial surface, wherein the shaped charge cavities are in fluid communication with the inner bore, and at least one inner bore escape port extending from the inner bore to an exterior of the body, and at least one cavity fluid escape port in communication with a respective one of the plurality of shaped charge cavities, which cavity fluid escape port extends from the respective one of the shaped charge cavities to the exterior of the body; b) inserting a cavity liner into each shaped charge cavity, which cavity liner is configured to retain an explosive material within the shaped charge cavity; and c) filling the inner bore and the plurality of shaped charge cavities with an explosive material.

In some embodiments of the above aspect, the perforating gun the inner bore extends between and is in fluid communication with the first axial end and the second axial end, and a first plug is disposed within inner bore proximate the first axial end and a second plug is disposed within inner bore proximate the first axial end, and the step of filling includes inserting explosive material includes filling the body until explosive material is visible in, or exits from, the at least one inner bore fluid escape port and each of the cavity fluid escape ports.

In any of the above aspect and embodiments, the inner bore has a diameter and the body has an outer diameter, and a ratio of the outer diameter of the body to diameter of the inner bore may be in the range of about 7:1 to about 19:1.

BRIEF DESCRIPTION OF THE DRAWINGS

The present disclosure is illustrated by way of example and not limited in the accompanying figures in which like reference numerals indicate similar elements. The drawing figures are not necessarily drawn to scale unless specifically indicated otherwise.

DETAILED DESCRIPTION

Figure 1:
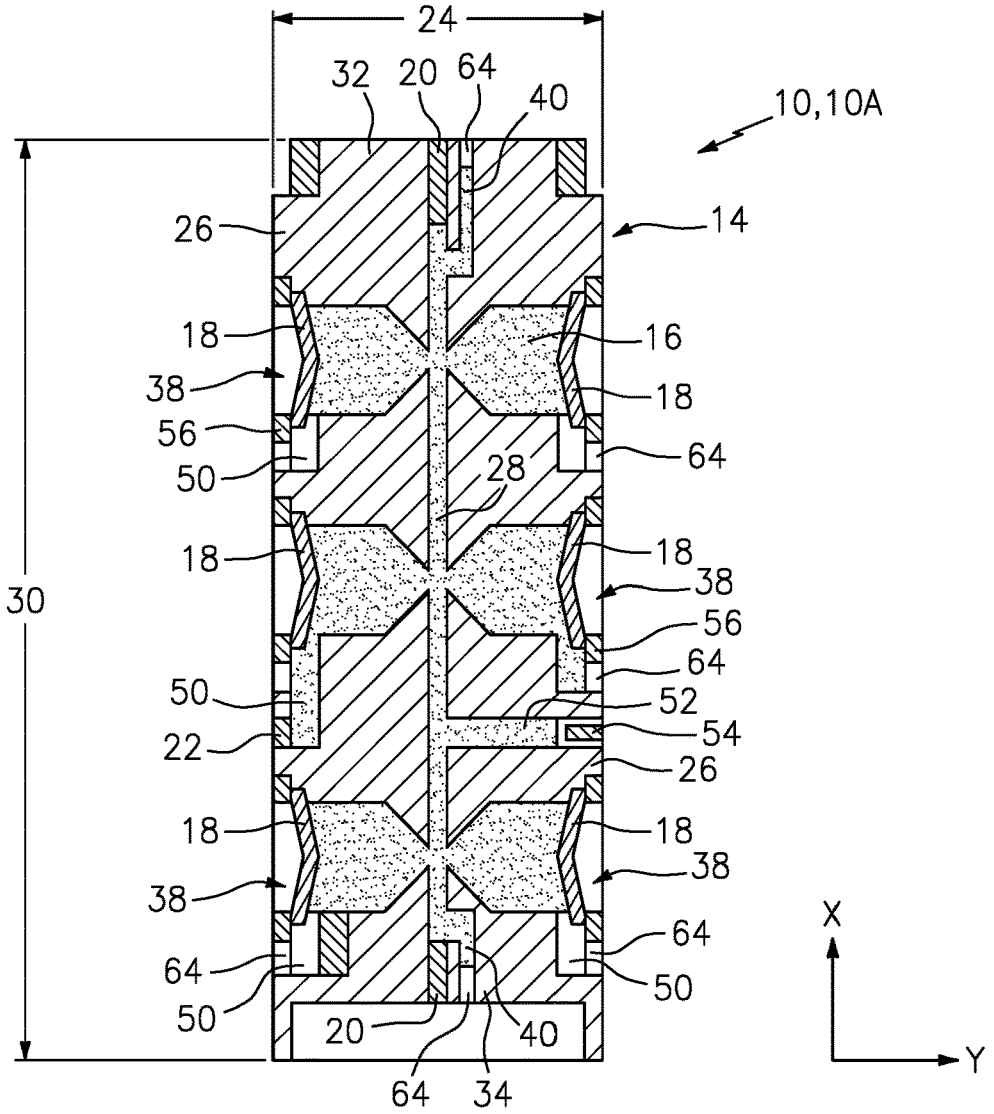
FIG. 1 illustrates a perforating gun section embodiment according to the present disclosure.

It is noted that various connections are set forth between elements in the following description and in the drawings (the contents of which are included in this disclosure by way of reference). It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities or a space/gap between the entities that are being coupled to one another.

Figure 2:
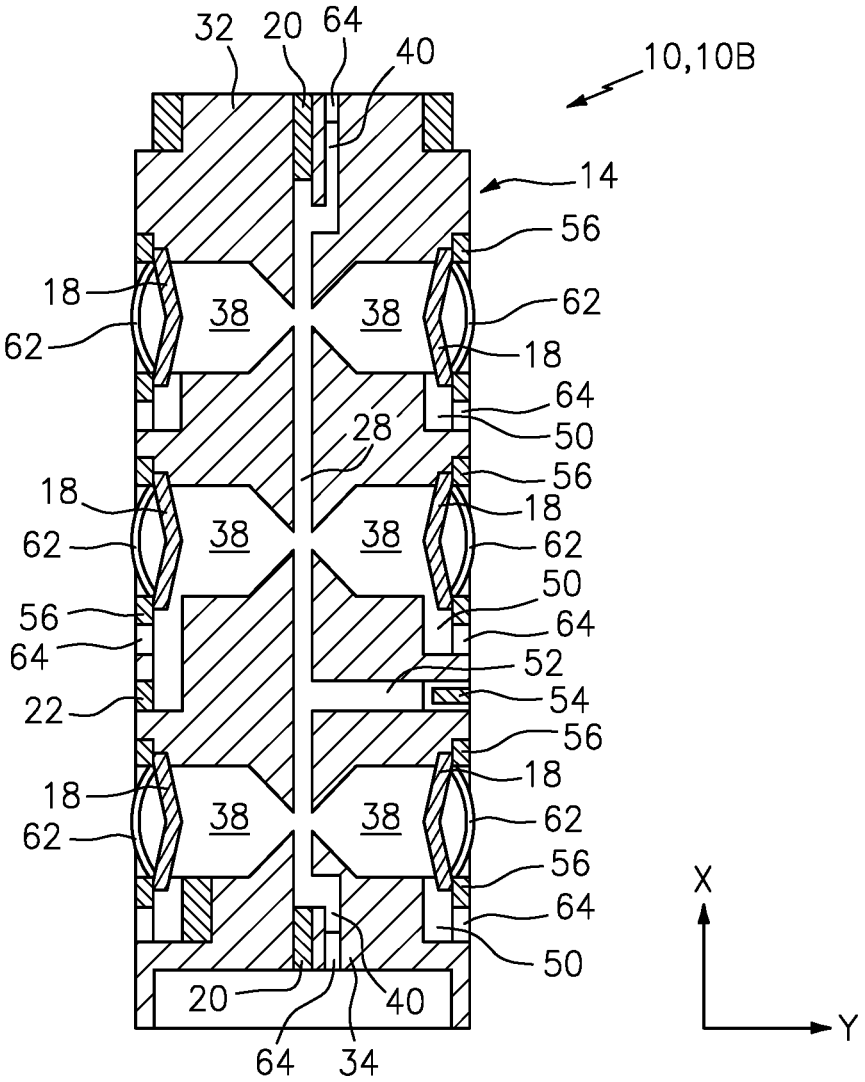
FIG. 2 illustrates a perforating gun section embodiment according to the present disclosure.
Figure 3:
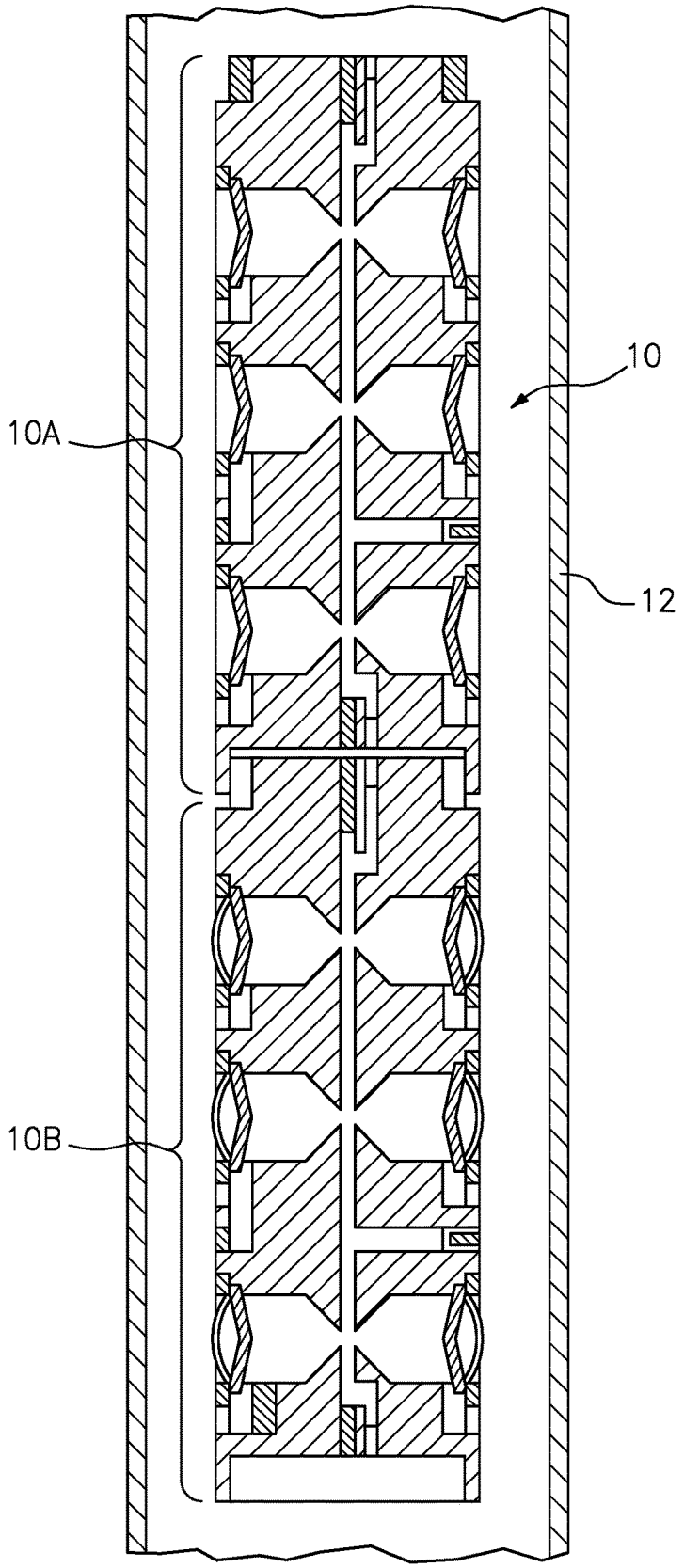
FIG. 3 illustrates a perforating gun embodiment according to the present disclosure, including two sections coupled together.

Referring to FIGS. 1-3, an embodiment of a perforating gun 10 is shown relative to the wellbore casing 12. The perforating gun 10 embodiment shown includes a first section 10A (See FIGS. 1 and 3) coupled with a second section 10B (See FIGS. 2 and 3). The perforating gun 10 may comprise only a single section, or may comprise two or more sections. The aforesaid sections may be coupled to one another in a variety of different ways; e.g., by screw thread, mechanical fastener, etc. In the embodiment shown the first and second sections have the same configurations. The present disclosure is not, however limited to this embodiment; e.g., different sections of the perforating gun 10 may be configured differently.

Each section of the assembled perforating gun 10 includes a body 14, explosive material 16, and a plurality of shaped charge cavity liners 18. FIG. 1 shows perforating gun section 10A as including explosive material 16, and FIG. 2 shows perforating gun section 10B without explosive material 16 to illustrate that a perforating gun 10 may be manufactured and shipped without explosive material 16 and the explosive material 16 subsequently added. In some embodiments, each perforating gun section further includes one or more explosive boosters 20 and compaction devices 22. The body 14 of each perforating gun section has an outer diameter 24, an outer radial surface 26, an inner bore 28, and a length 30. The outer diameter 24 extends radially (e.g., along a "Y" axis in the orthogonal axes shown in FIGS. 1 and 2) between opposing outer radial surfaces 26. The length 30 extends axially (e.g., along a "X" axis in the orthogonal axes shown in FIGS. 1 and 2) between a first axial end surface 32 and an opposing second axial end surface 34. The perforating gun 10 embodiment shown in FIGS. 1-3 is depicted as being cylindrical, but the present disclosure is not limited to a cylindrically shaped perforating gun 10.

Each perforating gun section may be initially formed with an inner bore 28, or the inner bore 28 may be formed within a solid body; e.g., by machining, etc. The inner bore 28 has a diameter 36 that is small relative to the outer diameter 24 of the body 14. For example, a body 14 having an outer diameter 24 in the range of about four to seven inches (4.0-7.0") may have an inner bore diameter 36 of about 0.3-0.4 inches. The specific inner bore diameter 36 and body outer diameter 24 can be varied to suit a number of different applications; e.g., the dimensions of the body 14 may be varied to suit the well casing inner diameter, etc. In most applications, the body 14 has an outer diameter 24 to inner bore diameter 36 ratio in the range of about 7:1 to about 19:1. In most applications, the inner bore diameter is preferably at least about 0.3 inches. The inner bore 28 extends between the first axial end surface 32 and the second axial end surface 34; e.g., a distance from one of the axial end surfaces that is sufficient so the inner bore 28 can connect with each shaped charge cavity 38. In the embodiment shown in FIGS. 1 and 2, the inner bore 28 extends from the first axial end surface 32 to the second axial end surface 34, thereby providing an internal passage through the entirety of each perforating gun section.

The perforating gun section body 14 includes a fluid (e.g., air) escape port 40 in communication with the inner bore 28 (which fluid escape port may be referred to as an "inner bore fluid escape port 40"). In preferred embodiments, a fluid escape port 40 is disposed proximate each axial end of the inner bore 28. Each fluid escape port 40 extends from the inner bore 28 to an outer surface of the body 14, thereby establishing a fluid passage between the inner bore 28 and the outer surface in the absence of a material blocking the air escape port 40. In the example shown in FIGS. 1 and 2, each penetrating gun section includes a fluid escape port 40 that extends from the inner bore 28 to an axial end surface 32, 34 of the body 14. Each fluid escape port 40 intersects with the inner bore 28 an axial distance away from the respective axial end surface 32, 34 to penult the inclusion of an explosive booster 20 (discussed below) disposed within inner bore 28 at the respective axial end surface 32, 34.

The body 14 may be made from a variety of different materials, and therefore is not limited to any particular material. An acceptable material is, for example, a K-55 steel that has a yield strength of 55,000 psi. In some embodiments, the body 14 (and/or parts of the perforating gun 10) may be made of a material that will erode or dissolve in a well environment; e.g., a material that will react (e.g., dissolve or erode) in the presence of materials typically found within a well environment. As a result, the need to remove a perforating gun 10 subsequent to operation of the gun may be diminished or eliminated. An example of a material that may be used to form the perforating gun body 14 and/or parts of the perforating gun 10 that dissolves or erodes is zinc or a zinc alloy material.

Figure 4:
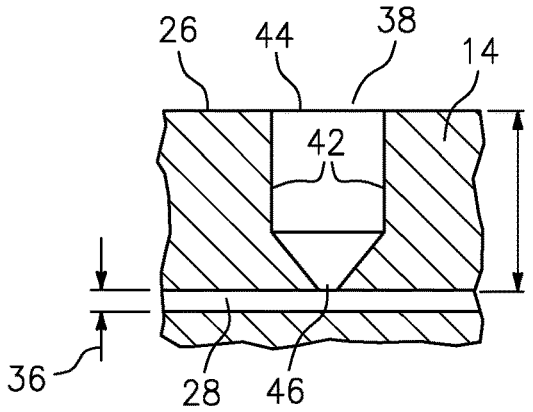
FIG. 4 is a diagrammatic partial sectional view of a perforating gun body embodiment, showing a shaped charge cavity in communication with the inner bore.

The body 14 includes a plurality of shaped charge cavities 38 disposed in the outer radial surface 26 of the body 14. Each of the shaped charge cavities 38 disposed within the body 14 may have the same geometry, or the plurality of shaped charge cavities 38 may include different geometries. The present disclosure is not limited to any particular shaped charge cavity 38 geometry. FIG. 4 illustrates a diagrammatic view of a shaped charge cavity 38 in communication with the inner bore 28. Each shaped charge cavity 38 is defined by one or more lateral surfaces 42, an outer radial end 44, and a base end 46. The outer radial end 44 is open to allow access into the cavity 38. The one or more lateral surfaces 42 extend between the outer radial end 44 (which outer radial end 44 is disposed at a plane co-planar with the outer radial surface 26) to the base end 46. The radial depth 48 of each shaped charge cavity 38 extends along a radial line extending from the base end 46 to the outer radial end 44. The base end 46 of each shaped charge cavity 38 intersects with the inner bore 28 and creates a fluid passage between the respective shaped charge cavity 38 and the inner bore 28. The volume(s) of the shaped charge cavities 38 is chosen so that an adequate amount of explosive material can be held within the shaped charge cavity 38 as will be described below. Each shaped charge cavity 38 is fluidically connected to the outer radial surface 26 of the body 14 by one or more fluid (e.g., air) escape ports 50 (which may be referred to as "cavity fluid escape ports 50"). Preferably, the fluid escape port(s) 50 intersect a lateral surface 42 of the respective shaped charge cavity 38 proximate the shaped charge cavity liner 18 as will be discussed below.

Figure 5:
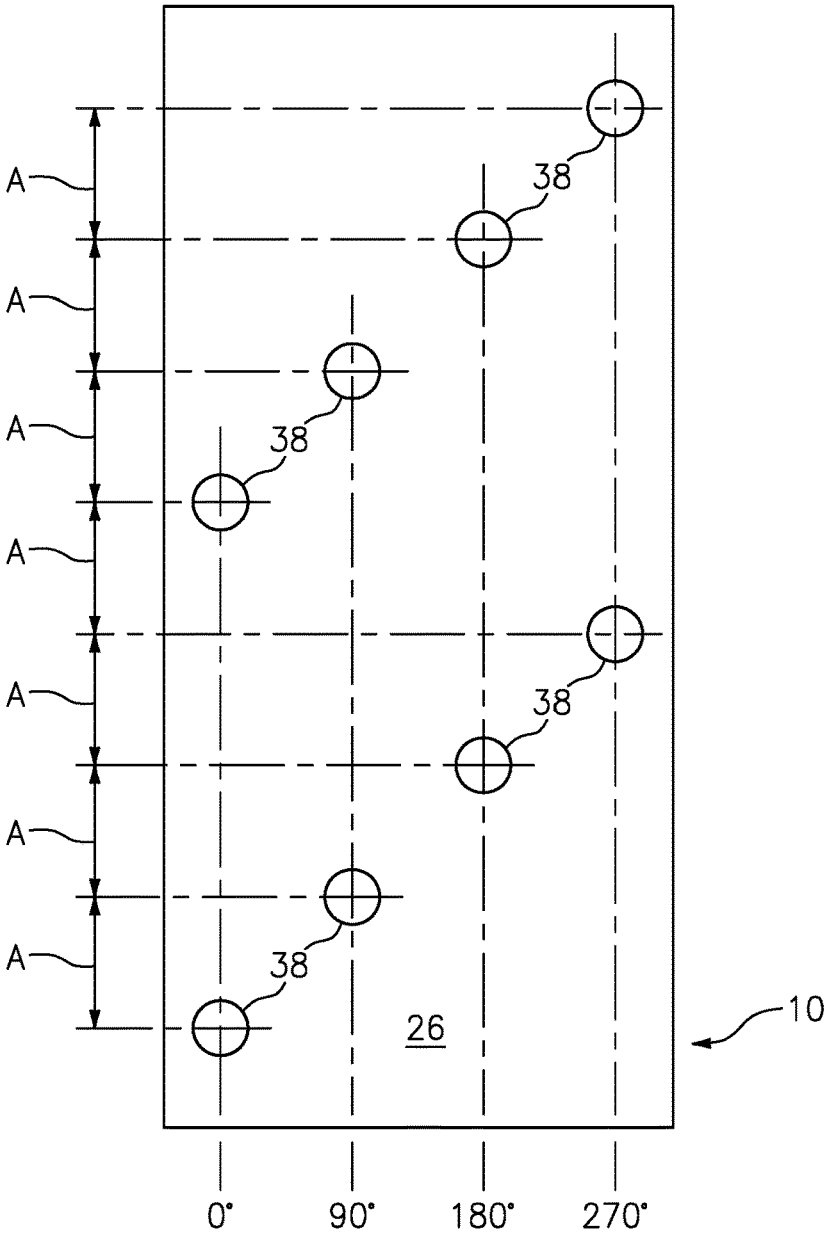
FIG. 5 is a diagrammatic view of a perforating gun section having a shaped charge cavity pattern.
Figure 6:
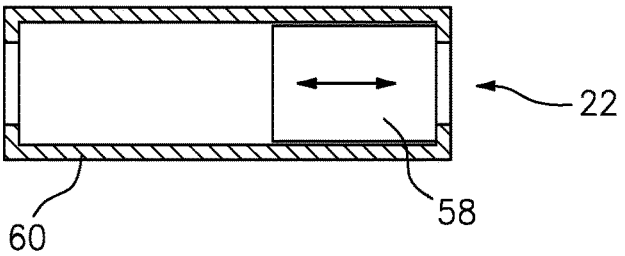
FIG. 6 is a diagrammatic view of a compaction device.
Figure 7:
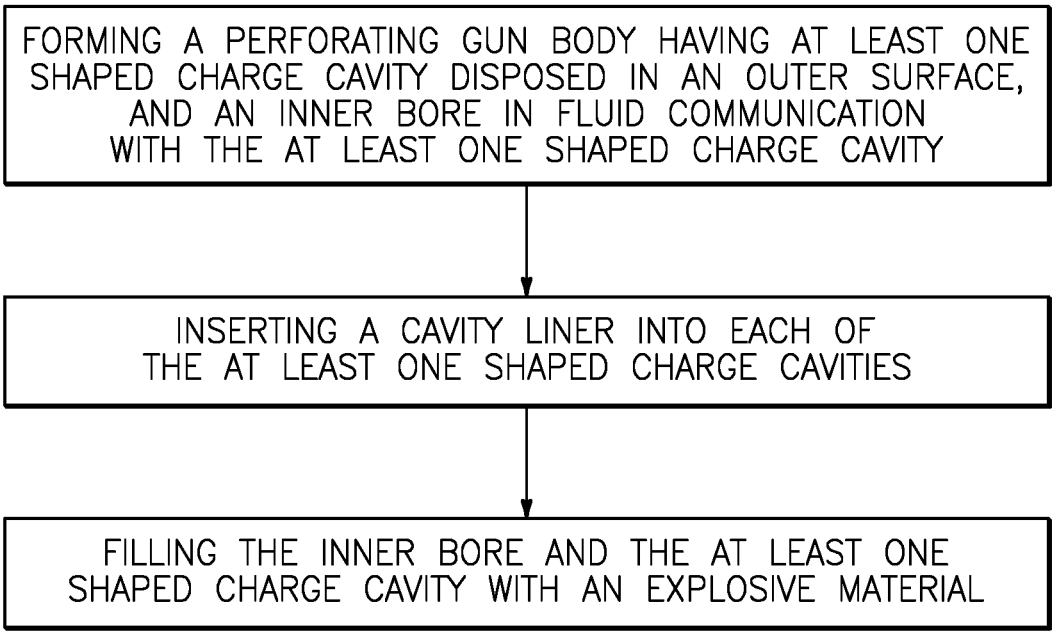
FIG. 7 is a block diagram illustrating a method for producing embodiments of the present perforating gun.

The plurality of shaped charge cavities 38 may be positioned at a variety of axial and circumferential positions (sometimes referred to as "phasing"); e.g., chosen to satisfy the specific application at hand. The axial spacing of the shaped charge cavities 38 may be uniform (e.g., a shaped charge cavity 38 every "A" distance), or may be non-uniform. The circumferential spacing of the shaped charge cavities 38 may be uniform (e.g., a shaped charge cavity 38 every "90" degrees), or may be non-uniform. FIG. 5 diagrammatically illustrates a body 14 configuration where the outer radial surface 26 of body 14 is shown in a planar manner (i.e., the outer surface is "unrolled") so the relative position of the shaped charge cavities 38 can be seen in a single view. In this example, the shaped charge cavities 38 are uniformly separated every "A" distance in the axial direction, and are uniformly separated every "90" degrees circumferentially. In this exemplary configuration, therefore, the shaped charge cavities 38 are positioned along a line that spirals around the circumference of the body 14. The present disclosure is not limited to this embodiment. The diagrammatic view shown in FIGS. 1 and 2, for example, shows shaped charge cavities 38 disposed radially across from one another.

In some embodiments, the body 14 includes at least one fill port 52 that extends from the inner bore 28 to the outer radial surface 26 of the body 14, providing a fluid passage through which an explosive material 16 can be passed from the exterior of the penetrating gun section into the inner bore 28 and shaped charge cavities 38. The fill port 52 may be configured to receive a one-way pressure relief valve 54 that allows a pressurized fluid (e.g., a gas) to escape from the inner bore 28 to the exterior of the penetrating gun. The one-way pressure valve 54 is configured to prevent ingress of well materials disposed around the penetrating gun 10 into the inner bore 28 under well hydrostatic pressures.

A variety of different explosive materials 16 can be used with the present disclosure and the present disclosure is not, therefore, limited to any particular explosive material. Acceptable examples of explosive materials 16 include, but are not limited to, Cyclotrimethylenetrinitramine, C3H6N606 (sometimes referred to as "Royal Demolition Explosive" or "RDX"), cyclotetramethylene-tetranitramine (sometimes referred to as "High Melting Explosive" or "HMX"), Hexanitrostilbene (sometimes referred to as "HNS" or "JD-X"), and 2,6-Bis(Picrylamino)-3,5-dinitropyridine (sometimes referred to as "PYX") Preferably, the explosive material 16 is in a form that can be wetted (e.g., into a fluid form such as a slurry having material properties that allows the wetted explosive material 16 to pass through the fill port 52, through the inner bore 28, into the plurality of shaped charge cavities 38, and into the respective air escape ports 40, 50, as will be explained below). A variety of different carrier materials (e.g., water) can be used to "wet" the explosive material, and the present disclosure is therefore not limited to any particular carrier material. Preferably, however, the carrier material is one that can be readily removed from the explosive material 16; e.g., by exposure to an elevated temperature and/or pressure as described below.

Each of the shaped charge cavity liners 18 is configured to mate with a respective shaped charge cavity 38. Each cavity liner 18 is configured to retain explosive material 16 within a shaped charge cavity 38 in which it is installed. The cavity liner 18 may also form a seal that prevents well materials from contacting the explosive material 16. The present disclosure is not limited to any particular cavity liner 18 configuration. The cavity liners 18 shown in FIGS. 1 and 2, for example are configured as concave shaped disks (e.g., conical, parti-spherical, parabolic, etc.), with the "peak" of the disk pointing toward the base end 46 of the shaped charge cavity 38. Each cavity liner 18 may be disposed within the shaped charge cavity 38 in contact with the one or more lateral surfaces 42 of the shaped charge cavity 38. Alternatively (as shown in FIGS. 1 and 2), a cavity liner 18 may be received within a shallow bore that surrounds the shaped charge cavity 38 at the outer radial end 44. The cavity liners 18 may be held in place by a variety of different mechanisms (e.g., a press fit, a mechanical retainer, an adhesive, weld, solder, screw thread, etc.) and the present disclosure is not limited to any particular mechanism for securing the cavity liner 18. FIGS. 1 and 2 show liner retaining rings 56 that are used to hold the cavity liners 18 in place. Examples of cavity liner 18 materials include, but are not limited to, copper, brass, steel, and Inconel.

As indicated above, in some embodiments each perforating gun section further includes one or more explosive boosters 20. The one or more explosive boosters 20 may be disposed within the inner bore 28. The perforating gun section embodiments shown in FIGS. 1 and 2, for example, include explosive boosters 20 disposed in the inner bore 28 proximate each axial end surface 32, 34 of the perforating gun section. The explosive boosters 20 are inserted into the inner bore 28 in a manner so they "plug" the inner bore 28 and form a seal. The seal created by the explosive booster 20 prevents ingress of well materials into the inner bore, and prevents explosive material from escaping the inner bore 28 during manufacture of the perforating gun section as described below. The explosive boosters 20 are also configured to create a "stop-fire", in the event an upper penetrating gun section fails to detonate properly. For example, in a perforating gun system that includes a plurality of sections the explosive boosters 20 may be configured to transfer sufficient energy from one perforating gun section to initiate an explosive booster 20 in an adjacent, subsequent perforating gun section under normal conditions. In the event the perforating gun system is compromised between sections (e.g., water fouled), the explosive booster 20 will typically not provide sufficient energy to initiate the subsequent gun section, thereby creating a "stop-fire". The present disclosure is not limited to any particular type of explosive booster 20. Examples of acceptable explosive boosters 20 include structures that include explosive materials such as, but not limited to RDX, HMX, HNS, or PYX.

In some embodiments, each perforation gun section includes one or more compaction devices 22. The present disclosure is not limited to any particular compaction device 22 configuration, other than one that can assist in increasing the compaction of the explosive material 16 within the body 14 of the perforating gun 10 section. FIG. 5, for example, diagrammatically shows a compaction device 22 embodiment that includes a sliding piston 58 that is translatable within a body 60 along an axis but is preferable restrained from exiting the device 22 (at least at one end). As will be explained below, a compaction device 22 may be installed within the outer radial surface 26 of the section body 14. The compaction device 22 may be installed so that the sliding piston 58 is initially disposed toward the outer radial surface 26 of the body 14, or the sliding piston 58 may be translated outwardly toward the outer radial surface 26 during installation of the explosive material 16. During operation when the perforating gun 10 is exposed to hydrostatic pressure within the wellbore casing 12, the sliding piston 58 may be forced inwardly (e.g., radially inwardly). As a result of the piston 58 translating inwardly, the compaction device 22 decreases the volume assumed by the explosive material 16 and thereby increases the compaction of the explosive material 16 within the perforation gun 10 section.

In some embodiments, a perforating gun 10 according to the present disclosure may also include one or more pressure barriers 62 disposed with respective shaped charge cavities 38. The present disclosure is not limited to any particular pressure barrier 62 configuration. The pressure barriers 62 shown in FIG. 2, for example are configured as flat or shaped disks (e.g., conical, parti-spherical, parabolic, etc.), with the "peak" of the pressure barrier 62 pointing away from the cavity liner 18 and the shaped charge cavity 38. The pressure barrier 62 may be disposed within the shaped charge cavity 38 in contact with the one or more lateral surfaces 42 of the shaped charge cavity 38, or may be in contact with the cavity liner 18, or in contact with a retainer ring 56, or any combination thereof. The pressure barriers 62 may be held in place by a variety of different mechanisms (e.g., a press fit, a mechanical retainer, an adhesive, weld, solder, screw thread, etc.) and the present disclosure is not limited to any particular mechanism. The pressure barriers 62 provide a degree of stand-off/isolation of the shaped charge (i.e., the explosive material 16 disposed within the shaped charge cavity 38) before the shaped charge encounters any fluid, which may improve jet performance of the shaped charge. The pressure barriers 62 may also help to protect against fluid ingress into the respective shaped charge cavity 38. Some pressure barriers 62 may be described and function as thin rupture disk membranes.

Referring to FIGS. 1-7, during manufacture of the body 14 of each perforating gun 10 section, the body is formed (e.g., by machining, casting, additive manufacturing, etc.) to include the outer radial surface 26, the inner bore 28, and the one or more shaped charge cavities 38. Typically, the body 14 is also formed to include at least one inner bore fluid escape port 40 in communication with the inner bore 28 and at least cavity fluid escape port 50 in communication with each shaped charge cavity 38, and at least one fill port 52. In the embodiments shown in FIGS. 1 and 2, the perforating gun section bodies 14 are also formed to receive a compaction device 22.

Subsequent to the body 14 being formed, the one or more explosive boosters 20 and the cavity liners 18 are installed. For example, in the perforating gun 10 section embodiment shown in FIGS. 1 and 2, an explosive booster 20 is installed at each end of the inner bore 28, and a cavity liner 18 and a liner retaining ring 56 is inserted in each shaped charge cavity 38. In the perforating gun 10 embodiment shown in FIG. 2, a pressure barrier 62 is also installed in each shaped charge cavity 38. Also in the embodiments shown in FIGS. 1 and 2, a compaction device 22 is installed in each perforating gun section body 14.

At this point in the assembly of each perforating gun 10, a cavity fluid escape port 50 fluidly connects each shaped charge cavity 38 with the inner bore 28, and with the exterior of the body 14. In addition, the inner bore 28 is in fluid communication with the exterior of body 15 via the inner bore fluid escape ports 40 and the fill port 52.

Explosive material is introduced into the inner bore 28 through the fill port 52. As indicated above, the explosive material 16 is preferably in a wetted form to facilitate flow of the explosive material 16 through the inner bore 28, into the plurality of shaped charge cavities 38, and into the respective fluid escape ports 40, 50. The wetted form of the explosive material 16 also makes it easier to create a relatively compacted form of the explosive material 16 within the various voids. The insertion of the explosive material 16 preferably continues until explosive material 16 escapes from all of the respective fluid escape ports 40, 50. During the insertion of the explosive material 16, any air that is present within the body 14 exits the body 14 via a fluid escape port 40, 50. Hence, all voids within the body 14 are filled with explosive material 16; i.e., the entire inner bore 28 from explosive booster 20 to explosive booster 20, the associated fluid escape ports 40, 50, and all of the shaped charge cavities 38 are filled with explosive material 16. In those embodiments having a compaction device 22, the compaction device 22 may also be filled with explosive material 16. In some instances, it may be desirable to block certain of the fluid escape ports 40, 50 during the insertion process to ensure the desired flow and insertion of explosive material 16 throughout the body 14.

After the body cavities 28, 38 and ports 40, 50 are filled with explosive material 16, some amount of explosive material 16 is removed from the respective fluid escape ports 40, 50 to permit the insertion of a seal material 64 into the respective fluid escape port 40, 50. The seal material 64 prevents well materials from entering the fluid escape ports 40, 50 and potentially fouling the explosive material 16.

Once the explosive material 16 is completely inserted into the body 14, a one-way pressure relief valve 54 may be installed into the fill port 52.

As stated above, a perforating gun 10 according to the present disclosure may comprise a single perforating gun 10 section or a plurality of perforating gun 10 sections to suit the application at hand. For those applications where it is desirable to use more than one perforating gun 10 section, the sections (e.g., 10A, 10B) can be combined together to create the desired length and performance perforating gun 10.

During operation, as the perforating gun 10 is inserted into a wellbore casing 12 it will likely be exposed to increasing higher temperatures and pressures. The high temperature outside of the perforating gun 10 (when disposed within the well casing) also increases the temperature of the explosive material 16 within the body 14. As a result, any remaining carrier fluid (e.g., water) may escape the interior of the body 14 via the one-way pressure valve 54. In addition, the environmental pressure may also act on the explosive material 16 disposed within the body 14. For example, the pressure may cause a portion of the compaction device 22 (e.g., the piston) to move inwardly, thereby increasing the compaction of the explosive material 16. In addition in those embodiments that do not include pressure barriers 62 disposed within the shaped charge cavities 38, the cavity liners 18 may also move radially inwardly to increase the compaction of the explosive material 16 within the respective shaped charge cavities 38. Hence, the explosive material 16 is compressed to a degree of compaction (which may be referred to as a degree of density of the collective material) that is favorable for detonation of the explosive material 16.

A perforating gun section or system according to the present disclosure may be utilized with a variety of different systems for initiating a section (or sections of a system), and therefore is not limited to use with any particular initiating system. Initiating systems may include, for example, an electrical or electronic detonator that is used to fire into a first "top" explosive booster 20 (e.g., connected to the surface by a communications line), or by a mechanically actuated (TCP-type) initiator that fires into the top explosive booster 20, etc. Typically, once the top explosive booster is initiated, the perforating gun sections are initiated sequentially in a manner described above.

Technical effects and benefits of this disclosure include a perforating gun 10 that is manufactured of commercially available, off-the-shelf materials. Aspects of the disclosure may be used to increase the efficiency of a perforating gun 10 (illustratively measured in terms of detonation energy per unit length/area) while at the same time increasing/maximizing the reliability of the perforating gun 10. The manufacture of the perforating gun 10 may be simplified as the number/count of the discrete components that are used may be reduced/minimized relative to a conventional perforating gun 10. For example, whereas in conventional perforating guns the detonating cord and the shaped charges are separate components from a carrier body, in accordance with aspects of this disclosure the inner bore 28 and the shaped charge cavities 38 are formed in the body itself thereby eliminating the need for a detonating cord and independent liners for holding the shaped charges.

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional in accordance with aspects of the disclosure. One or more features described in connection with a first embodiment may be combined with one or more features of one or more additional embodiments.

What is claimed is:

1. A perforating gun, comprising:

a body having an axial length extending between a first axial end and a second axial end, and an outer radial surface extending between the first and second axial ends, an inner bore, and at least one shaped charge cavity disposed in the outer radial surface, wherein the shaped charge cavity is in fluid communication with the inner bore;

at least one inner bore fluid escape port in communication with the inner bore, which inner bore fluid escape port extends from the inner bore to an exterior of the body at one of the first axial end or the second axial end;

at least one cavity liner disposed in the shaped charge cavity and configured to retain an explosive material within the shaped charge cavity; and a fill port in fluid communication with the inner bore and the exterior of the body through the outer radial surface of the body, wherein the inner bore extends between and is in fluid communication with the first axial end and the second axial end.

2. The perforating gun of claim 1, wherein the at least one inner bore fluid escape port includes a first inner bore escape port extending from the inner bore to the first axial end of the body, and a second inner bore escape port extending from the inner bore to the second axial end of the body.

3. The perforating gun of claim 2, further comprising a first explosive booster disposed within the inner bore adjacent the first axial end, and a second explosive booster disposed within the inner bore adjacent the second axial end.

4. The perforating gun of claim 1, further comprising at least one cavity fluid escape port in communication with the shaped charge cavity, which cavity fluid escape port extends from the shaped charge cavity to an exterior of the body.

5. The perforating gun of claim 1, wherein the at least one shaped charge cavity includes a plurality of shaped charge cavities, with each shaped charge cavity in fluid communication with the inner bore, wherein the plurality of shaped charge cavities are spaced apart from one another along the axial length of the body, and the at least one cavity liner includes a plurality of cavity liners, one of which is disposed in each of the shaped charge cavities.

6. The perforating gun of claim 5, further comprising a plurality of cavity fluid escape ports, with each cavity fluid escape port in communication with a respective one of the plurality of shaped charge cavities, and each of which cavity fluid escape ports extends from the respective one of the shaped charge cavities to an exterior of the body.

7. The perforating gun of claim 1, further comprising an explosive material disposed within the inner bore and within the at least one shaped charge cavity.

8. The perforating gun of claim 1, wherein the inner bore has a diameter and the body has an outer diameter, and a ratio of the outer diameter of the body to diameter of the inner bore is in the range of about 7:1 to about 19:1.

9. The perforating gun of claim 1, wherein the inner bore is annularly disposed about an axial centerline of the body along the axial length of the body.

10. A perforating gun system, comprising:

a plurality of perforating gun sections, with each perforating gun section connected to at least one other perforating gun section;

wherein each perforating gun section includes:

a body having an axial length extending between a first axial end and a second axial end, and an outer radial surface extending between the first and second axial ends, an inner bore, and at least one shaped charge cavity disposed in the outer radial surface, wherein the shaped charge cavity is in fluid communication with the inner bore;

a first inner bore escape port extending from the inner bore to the first axial end of the body, and a second inner bore escape port extending from the inner bore to the second axial end of the body;

at least one cavity liner disposed in the shaped charge cavity and configured to retain an explosive material within the shaped charge cavity; and a fill port in fluid communication with the inner bore and the exterior of the body through the outer radial surface of the body, wherein the inner bore extends between and is in fluid communication with the first axial end and the second axial end.

11. The perforating gun system of claim 10, wherein the at least one shaped charge cavity includes a plurality of shaped charge cavities, with each shaped charge cavity in fluid communication with the inner bore, wherein the plurality of shaped charge cavities are spaced apart from one another along the axial length of the body, and the at least one cavity liner includes a plurality of cavity liners, one of which is disposed in each of the shaped charge cavities.

12. The perforating gun system of claim 11, further comprising a plurality of cavity fluid escape ports, with each cavity fluid escape port in communication with a respective one of the plurality of shaped charge cavities, and each of which cavity fluid escape ports extends from the respective one of the shaped charge cavities to an exterior of the body.

13. The perforating gun system of claim 10, further comprising an explosive material disposed within the inner bore and within the at least one shaped charge cavity.

14. A method of producing a perforating gun, comprising:

providing a perforating gun body having an axial length extending between a first axial end and a second axial end, and an outer radial surface extending between the first and second axial ends, an inner bore, and a plurality of shaped charge cavities disposed in the outer radial surface, wherein the shaped charge cavities are in fluid communication with the inner bore, and at least one inner bore escape port extending from the inner bore to an exterior of the body, and at least one cavity fluid escape port in communication with a respective one of the plurality of shaped charge cavities, which cavity fluid escape port extends from the respective one of the shaped charge cavities to the exterior of the body;

inserting a cavity liner into each shaped charge cavity, which cavity liner is configured to retain an explosive material within the shaped charge cavity; and inserting explosive material into the inner bore to fill the inner bore and the plurality of shaped charge cavities, after inserting the cavity liner into each shaped charge cavity, until explosive material is visible in, or exits from, the at least one inner bore fluid escape port and each of the cavity fluid escape ports, wherein the inner bore extends between and is in fluid communication with the first axial end and the second axial end, and a first plug is disposed within the inner bore proximate the first axial end and a second plug is disposed within inner bore proximate the second axial end.

15. The method of claim 14, further comprising inserting a plug material into the at least one inner bore fluid escape port and each of the cavity fluid escape ports after the body is filled with the explosive material.

16. The method of claim 15, wherein the explosive material is inserted through a fill port, and further including inserting a one-way pressure valve into the fill port after completing the filling.

17. The method of claim 14, wherein the inner bore has a diameter and the body has an outer diameter, and a ratio of the outer diameter of the body to diameter of the inner bore is in the range of about 7:1 to about 19:1.

18. A perforating gun, comprising:

a body having an axial length extending between a first axial end and a second axial end, and an outer radial surface extending between the first axial end and the second axial end, an inner bore, and at least one shaped charge cavity disposed in the outer radial surface, wherein the shaped charge cavity is in fluid communication with the inner bore;

at least one inner bore fluid escape port disposed within the body and in communication with the inner bore, which inner bore fluid escape port extends from the inner bore to an exterior of the body at one of the first axial end or the second axial end;

at least one cavity liner disposed in the shaped charge cavity and configured to retain an explosive material within the shaped charge cavity;

wherein the inner bore extends between the first axial end and the second axial end and is in fluid communication with the first axial end and the second axial end;

a fill port in fluid communication with the inner bore and the exterior of the body through the outer radial surface of the body; and a one-way pressure valve disposed within the fill port.

* * * * *